US005981455A

United States Patent [19]

Carrie et al.

[11] Patent Number: 5,981,455

[45] **Date of Patent: *Nov. 9, 1999**

[54] CLEANING COMPOSITIONS WITH SHORT CHAIN NONIONIC SURFACTANTS

[75] Inventors: Michel Jean Carrie, Strombeek-Bever, Belgium; William Ajalon Cilley, Cincinnati, Ohio; Peter Rosalia Joannes Geboes, Aartselaar, Belgium; Massimo Morini, Jette, Belgium; Louise Gail Scott, Sterrebeek, Belgium; Eddy Vos, Linden, Belgium; Ricky Ah-Man Woo, Hamilton, Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/522,391

[22] PCT Filed: Mar. 14, 1994

[86] PCT No.: PCT/US94/02746

§ 371 Date: Feb. 9, 1996

§ 102(e) Date: Feb. 9, 1996

[87] PCT Pub. No.: WO94/21770

PCT Pub. Date: Sep. 29, 1994

[30] Foreign Application Priority Data

Mar. 19, 1993 [EP] European Pat. Off. ..... 93870050

[51] Int. Cl.[6] ..... C11D 3/00; C11D 7/00

[52] U.S. Cl. ..... 510/218; 510/276; 510/238; 510/356; 510/362; 510/365; 510/370; 510/421

[58] Field of Search ..... 252/174.21, DIG. 1; 510/370, 365, 421, 218, 238, 276, 356, 362

[56] References Cited

U.S. PATENT DOCUMENTS

| | | | |
|---|---|---|---|
| 4,129,514 | 12/1978 | Caffarel et al. | 510/365 |
| 4,288,339 | 9/1981 | Wilsberg | 510/461 |
| 4,759,868 | 7/1988 | Clarke | 252/170 |
| 4,772,415 | 9/1988 | Adone | 252/111 |
| 4,784,798 | 11/1988 | Geke et al. | 510/421 |
| 4,965,009 | 10/1990 | Baur et al. | 252/142 |
| 5,707,948 | 1/1998 | Evers et al. | 510/217 |

FOREIGN PATENT DOCUMENTS

| | | | |
|---|---|---|---|
| 0 125 854 | 11/1984 | European Pat. Off. | C11D 1/83 |
| 0 496 188 A1 | 7/1992 | European Pat. Off. | C11D 3/20 |
| 0 503 219 A1 | 9/1992 | European Pat. Off. | C11D 3/30 |
| 2207981 | 11/1973 | France | C11D 1/72 |
| 1 462 134 | 3/1975 | United Kingdom | C07C 43/04 |
| 1 566 326 | 2/1977 | United Kingdom | C11D 10/02 |

*Primary Examiner*—Margaret Medley
*Attorney, Agent, or Firm*—Robert B. Aylor

[57] ABSTRACT

A composition comprising short chain alkoxylated alcohols as nonionic surfactants. The short chain alkoxylated alcohols provide superior cleaning compared to their homologues with longer chains as well as other benefits including, low foaming and skin mildness, and the ability to formulate concentrated compositions.

4 Claims, No Drawings

CLEANING COMPOSITIONS WITH SHORT CHAIN NONIONIC SURFACTANTS

This application is a 371 of PCT/US94/02746 filed on Mar. 14, 1994.

TECHNICAL FIELD

The present invention relates to cleaning compositions. Although the present invention applies primarily to hard surface cleaning compositions, it may also be of interest for other cleaning compositions including dishwashing and laundry detergent compositions.

BACKGROUND

A variety of cleaning compositions have been described in the art. There is a constant strive for the development of cleaning compositions with better performance in several respects. Better cleaning on all soils, including greasy soils and soap scum is of course a principal object, both for neat and diluted compositions which are often used in the cleaning of hard surfaces. However other properties are also highly desirable, particularly mildness to the skin, the ability to remove soap scum and to produce limited suds.

All such objects can be independently achieved by using various ingredients which are generally added for a specific purpose. For instance silicone oils are typically added solely to control sudsing. Another example is the use of solvents to boost neat cleaning. While such additives meet the desired object, they also grief the cost of formulating efficient cleaning compositions.

It has now been found that certain nonionic surfactants, namely alkoxylated alcohols with a short alkyl chain in the alcohol, hereinafter short chain alkoxylated alcohols, meet the above objects. Indeed, it has been found that said short chain alkoxylated alcohols are particularly efficient in cleaning. Such short chain alkoxylated alcohols further meet the other objects of providing surfactants which are low foaming and which are mild to the skin. Another advantage is that such short chain alkoxylated alcohols are particularly suitable for formulating concentrated cleaning compositions.

EP 125 854 discloses a composition comprising 2.7% of C8EO4.8 together with 14.2% of ammonium C11.8 linear alkyl benzene sulphonate, 10.4 of ammonium C12–13 alkyl ethoxylated sulphate, 8.6% magnesium C12–13 alkyl sulphate, 4.0% coconut monoethanolamide and 9.1% ethanol and water. EP 125 854 however fails to draw the difference between long and short chain nonionic surfactants.

EP 496 188 discloses an aqueous solution comprising 3% of C8EO6 and 8% maleic acid. EP 486 188 does not draw the difference between long and short chain nonionic surfactants.

SUMMARY OF THE INVENTION

The present invention encompasses aqueous cleaning compositions comprising a short chain alkoxylated alcohol surfactant according to the formula RO(A)nH, wherein R is a C6 to C10 hydrocarbon chain, A is ethylene oxide or propylene oxide or mixtures thereof and n is of from 1 to 10, or mixtures thereof, and other conventional cleaning ingredients selected from anionic, cationic, zwitterionic and nonionic co-surfactants, including short chain co-surfactants, builders, solvents, bleaches and minors including dyes, perfumes, or mixtures thereof.

The present invention also encompasses such compositions in a concentrated form, the use of said surfactants for neat grease cleaning, for dilute grease cleaning and for soap scum cleaning. The present invention further encompasses the use of said surfactants as skin mild surfactants and as low foaming surfactants.

DETAILED DESCRIPTION OF THE INVENTION

In a main embodiment, the present invention encompasses aqueous compositions which comprise conventional cleaning ingredients and a short chain alkoxylated alcohol surfactant.

The short chain nonionic surfactants for use herein are alkoxylated alcohols according to the formula RO(A)nH, wherein R is a C6 to C10 hydrocarbon chain and n, representing the average alkoxylation degree, is from 1 to 10, or mixtures thereof. R is indifferently straight or branched. A is ethylene oxide or propylene oxide or mixtures thereof. Similar nonionic surfactants which have longer R groups than those of the present invention are known in the art and are commonly used in cleaning compositions. The present invention is based on the finding that alkoxylated alcohols with shorter R groups provide better cleaning, as well as the multiple benefits described herein.

Suitable surfactants for use herein can be readily made by condensing alcohols having the desired chain length with propylene or ethylene oxide, or mixtures thereof, as disclosed in the art for alkoxylated alcohols with longer chains. Suitable short chain alkoxylated alcohols for use herein are also commercially available from several suppliers, for instance Dehydol O4 ® from Henkel (C8EO4), Mergital C4 ® from Sidobre (C8EO4), and Imbentin AG/810/050 and AG/810/080 ® from Kolb (respectively C8-10EO5 and C8-10EO8).

The compositions according to the present invention comprise from 0.1% to 50% by weight of the total composition of said short chain alkoxylated alcohols, preferably from 1% to 30%, most preferably from 1.5% to 20%.

The short chain alkoxylated alcohols herein are particularly suitable for the formulation of so-called concentrated cleaning compositions. Indeed, the short chain alkoxylated alcohols have a very high solubility in water, but they are also able to solubilize other conventional organic ingredients for cleaning compositions, such as perfumes. Thus, in an embodiment of the present invention, cleaning compositions are provided in a concentrated form, which only comprise from 1% to 80% by weight of the total composition of water, preferably from 30% to 70%. Such compositions typically comprise from 0.1% to 50% by weight of the total composition of said short chain alkoxylated alcohols, preferably from 5% to 30%.

Some of said short chain alcohol ethoxylates have been found to provide superior neat grease cleaning, compared to other alcohol ethoxylates with longer chains. Thus, in another embodiment, the present invention encompasses the use of said surfactants for neat grease cleaning. As used herein, neat grease cleaning means the cleaning of greasy soils, using an aqueous solution comprising at least one of the surfactants according to the present invention, within the ranges above. Greasy soils are typically found in kitchens or bathrooms.

For use in neat cleaning, and when R is in the higher range, i.e. 10, it is preferred to use lower ethoxylation degrees, typically 1 to 6. Preferred short chain alkoxylated alcohols for use in neat grease cleaning are those according to the formula hereinabove where R is a hydrocarbon chain from C6 to C8 and n is from 1 to 10. Preferred short chain alcohol ethoxylates for neat grease cleaning are the surfactants according to the formula above where R is a C6 hydrocarbon chain and n is 4 or 6 (C6EO4 and C6EO6); or R is a C8 hydrocarbon chain and n is 4 or 6 (C8EO4 and C8EO6); or R is a C8 hydrocarbon chain and n is 10 (C8EO10).

Some of the short chain alcohol ethoxylates herein have also been found to provide superior dilute grease cleaning, compared to solvents. Therefore, in a further embodiment, the present invention encompasses the use of said surfactants for dilute grease cleaning. As used herein, dilute grease cleaning means the cleaning of greasy soils using an aqueous solution comprising a surfactant according to the present invention, in the ranges described above, but which is diluted typically in 10 to 150 times its weight in water before it is used to clean the greasy soils. Dilute cleaning compositions and conditions have been described for instance in EP 503 219.

Suitable short chain alkoxylated alcohols for use in dilute grease cleaning are those according to the formula hereinabove where R a hydrocarbon chain from C8 to C10, and n is from 1 to 10. For dilute cleaning, it has been found that for a given R group, it is preferred to use higher ethoxylation degrees. Preferred short chain alkoxylated alcohols herein for dilute grease cleaning are those according to the formula herein above where R is a C8 hydrocarbon chain and n is of from 4 to 10, preferably 4, 6 or 10 (C8EO4, C8EO6, C8EO10), R is a C10 hydrocarbon and n ranges from 3 to 6 or n is 10 (C10EO3, C10EO4, C10EO5, C10EO6, C10EO10), as well as a mixture of surfactants where R is a C10 hydrocarbon and a C8 hydrocarbon and n is 5 (C8-10EO5), or n is 8 (C8-C10EO8).

Furthermore, some of the short chain alcohol ethoxylates herein have been found to be particularly efficient in cleaning soap scum, compared to other alkoxylated alcohols with longer chains. Accordingly, in a further embodiment, the present invention encompasses the use of said surfactants for cleaning soap scum. Soap scum, which is mainly found in bathroom is quite peculiar in its composition and traditionally leads detergent manufacturers to formulate specialty cleaning products for bathroom environment. The present invention is thus particularly applicable to the formulation of such specialty products.

Suitable short chain alkoxylated alcohols for use in cleaning soap scum are those wherein, in the formula hereinabove, R a hydrocarbon chain from C8 to C10, and n is from 1 to 10. When R is in the higher range, i.e. towards 10, it is preferred to use lower ethoxylation degrees, typically 1 to 6. Preferred alkoxylated alcohols for cleaning soap scum are those where, in the formula hereinabove, R is a C8 hydrocarbon chain and n is of from 4 to 10, preferably 4, 6 or 10 (C8EO4, C8EO6, C8EO10), R is a C10 hydrocarbon and n ranges from 3 to 6 (C10EO3, C10EO4, C10EO5, C10EO6), as well as a mixture of surfactants where R is a C10 hydrocarbon and a C8 hydrocarbon and n is 5 (C8-10EO5), or n is 8 (C8-C10EO8).

Furthermore, some of the short chain alcohol ethoxylates herein have been found to be of particular interest as they produce very limited sudsing or foaming compared to other alcohol ethoxylates. Accordingly, in a further embodiment, the present invention encompasses the use of said surfactants as low foaming surfactants. Low foaming surfactants are usually of interest for heavy duty laundry detergents, but also for hard surface cleaners which are designed to be used as no-rinse products in dilute form.

The surfactants within the present invention which have been found to produce low foaming are those according to the formula herein above where R is a C6 to C10 hydrocarbon chain and n is of from 1 to 10. Preferred low foaming surfactants herein are those where R is a C6 hydrocarbon chain and n is 4 or 6 (C6EO4, C6EO6); or R is a C8 hydrocarbon chain and n is 4, 6 or 10 (C8EO4, C8EO6, C8EO10), R is a C10 hydrocarbon and n ranges from 3 to 6 (C10EO3, C10EO4, C10EO5, C10EO6), as well as a mixture of surfactants where R is a C10 hydrocarbon and a C8 hydrocarbon and n is 5 (C8-10EO5), or n is 8 (C8-C10EO8); or mixtures thereof.

Furthermore, some of the short chain alcohol ethoxylates herein have been found to be of particular interest as they are particularly mild to the skin. Accordingly, the present invention encompasses the use of said surfactants as skin mild surfactants. Mildness to the skin is quite an advantage when formulating products which are bound to be in contact with the user's skin. Such is the case for dishwashing compositions, or hard surface cleaning compositions. Skin mildness benefits are usually advertised when they exist in a given product.

The surfactants within the present invention which have been found to be particularly mild to the skin are those according to the formula herein above where R is a C6 to C8 hydrocarbon chain and n is of from 1 to 10. Preferred surfactants are those where R is a C6 hydrocarbon chain and n is 4 or 6 (C6EO4, C6EO6), or R is a C8 hydrocarbon chain and n is 4, 6 or 10, or mixtures thereof (C8EO4, C8EO6, C8EO10).

The compositions according to the invention further comprise conventional ingredients selected from other nonionic, anionic, cationic and zwitterionic co-surfactants (from 0% to 30% by weight of the total composition, preferably from 1% to 20%), builders (from 0% to 20% by weight of the total composition, preferably from 1% to 10%), solvents (from 0% to 20% by weight of the total composition, preferably from 0% to 5%), non-hypochlorite bleaches (from 0% to 10% by weight of the total composition, preferably from 1% to 5%) and minors including dyes, perfumes, all of which are well known and extensively described in the art.

The exact formulation of the compositions according to the present invention depend on the end-use envisioned. Mixtures of the short chain surfactants according to the present invention can also be used in order to combine several benefits. Compositions according to the present invention can be formulated indifferently as alkaline and acidic hard surface cleaners, dishwashing products or laundry detergents.

The present invention will be further illustrated by the following examples.

EXAMPLES

The following compositions are made by mixing the listed ingredients in the listed proportions.

| | Weight % | | | | |
|---|---|---|---|---|---|
| Ingredients: | 1 | 2 | 3 | 4 | 5 |
| C8EO4 | 2.5 | — | 2.0 | 4.0 | 20 |
| C8EO10 | — | 4.0 | — | — | — |
| Lutensol AO30 ® | — | — | — | 2.0 | 20 |
| Lutensol AO7 ® | — | — | — | 1.0 | — |
| Na Paraffin Sulfonate | — | — | — | 3.0 | — |
| Fatty Acid | — | — | — | 0.4 | — |
| Citric Acid | 5.5 | 5.5 | 3.0 | 2.0 | 3 |
| Triethanolamine | 1.9 | 1.9 | — | 1.0 | — |

-continued

| Ingredients: | Weight % | | | | |
|---|---|---|---|---|---|
| | 1 | 2 | 3 | 4 | 5 |
| MEA up to pH | — | — | — | — | 7 |
| Ammonia up to pH | 3.5 | 3.5 | 2.0 | — | — |
| NaOH up to pH | — | — | — | 10.5 | — |
| Water and minors | up to 100% | | | | |

Lutensol AO30 is C13-15(EO)30
Lutensol AO7 is C13-15(EO)7
MEA stands for monoethanolamine.

Compositions 1 and 2 hereinabove are particularly efficient in removing soapscum and are therefore particularly suitable as a bathroom cleaner. Composition 3 is particularly effective in providing low suds. Composition 4 is particularly effective on dilute and neat grease cleaning. Composition 5 is a concentrated composition.

What is claimed is:

1. An aqueous cleaning composition, being mild to the skin, consisting essentially of:

(a) from about 0.1% to about 50% of a short chain nonionic surfactant according to the formula $RO(A)_nH$, wherein R is a $C_6$ or $C_8$ hydrocarbon chain, A is ethylene oxide or propylene oxide, and n is 4; or mixtures of said surfactants;

(b) from 1% to 5% non-hypochlorite bleach;

(c) one or more conventional cleaning ingredients selected from:

(i) 1%–20% of a cosurfactant selected from the group consisting of anionic, cationic, zwitterionic, and nonionic co-surfactants, wherein the said nonionic cosurfactants are selected from the group consisting of $C_{13}$ to $C_{15}$ alcohols ethoxylated with 7 moles of ethylene oxide and $C_{13}$ to $C_{15}$ alcohols ethoxylated with 30 moles of ethylene oxide, (ii) 1%–10% builders, and (d) up to 97.9% water.

2. The composition of claim 1 wherein the amount of Component (a) is from 1% to 30%.

3. The composition of claim 2 wherein in Component (a) R is $C_6$.

4. The composition of claim 2 wherein in Component (a) R is $C_8$.

* * * * *